US008684217B2

(12) United States Patent
Bruehl et al.

(10) Patent No.: US 8,684,217 B2
(45) Date of Patent: Apr. 1, 2014

(54) EASY-OPEN PACKAGE

(75) Inventors: Peter Brian Bruehl, Greenville, WI (US); Scott Gregory Pockat, Oshkosh, WI (US); Aaron John Wallander, Neenah, WI (US)

(73) Assignee: Curwood, Inc., Oshkosh, WI (US)

( * ) Notice: Subject to any disclaimer, the term of this patent is extended or adjusted under 35 U.S.C. 154(b) by 256 days.

(21) Appl. No.: 12/971,212

(22) Filed: Dec. 17, 2010

(65) Prior Publication Data

US 2012/0152954 A1 Jun. 21, 2012

(51) Int. Cl.
*B65D 41/02* (2006.01)

(52) U.S. Cl.
USPC ..... 220/359.4; 220/270; 220/359.2

(58) Field of Classification Search
USPC ..... 220/265, 266, 277, 270, 359.1, 359.2, 220/359.3, 359.4, 276, 268, 260; 206/807, 206/532; 229/123.2, 200, 125.35, 210, 212, 229/237
See application file for complete search history.

(56) References Cited

U.S. PATENT DOCUMENTS

| | | | | |
|---|---|---|---|---|
| 4,072,233 | A | 2/1978 | Kramer et al. | |
| 4,944,409 | A | 7/1990 | Busche et al. | |
| 5,172,812 | A * | 12/1992 | Wharton et al. | 206/531 |
| 5,178,293 | A | 1/1993 | Suzuki et al. | |
| 5,318,824 | A * | 6/1994 | Itaya et al. | 428/178 |
| 5,407,751 | A | 4/1995 | Genske et al. | |
| 5,878,888 | A * | 3/1999 | Faughey et al. | 206/530 |
| 6,974,032 | B2 * | 12/2005 | Intini | 206/532 |
| 7,017,774 | B2 | 3/2006 | Haedt | |
| 7,422,782 | B2 | 9/2008 | Haedt et al. | |
| 7,475,780 | B2 | 1/2009 | Hinze et al. | |
| 7,703,625 | B2 | 4/2010 | Westphal | |
| 7,757,879 | B2 | 7/2010 | Schuetz et al. | |
| 8,056,716 | B2 * | 11/2011 | Fonteyne et al. | 206/365 |
| 2006/0249422 | A1 * | 11/2006 | Bates, Jr. | 206/532 |
| 2006/0257599 | A1 * | 11/2006 | Exner et al. | 428/35.2 |
| 2006/0269707 | A1 | 11/2006 | Berbert | |
| 2007/0023435 | A1 | 2/2007 | Sierra-Gomez et al. | |
| 2007/0082161 | A1 | 4/2007 | Cruz et al. | |
| 2009/0142454 | A1 | 6/2009 | Clark et al. | |
| 2011/0262589 | A1 * | 10/2011 | Safarik | 426/5 |

FOREIGN PATENT DOCUMENTS

| | | |
|---|---|---|
| EP | 1 340 693 A1 | 9/2003 |

* cited by examiner

*Primary Examiner* — Jeffrey Allen
(74) *Attorney, Agent, or Firm* — Tom J. Hall

(57) ABSTRACT

A rigid or semi-rigid tray is provided, including a bottom and at least one side wall which forms at least one recessed product-receiving compartment, and a flange extending around the tray which forms distal edges of the container. The tray further includes a lidding film affixed to the flange which forms a peelable heat-seal extending around the product-receiving compartment and the distal edges of the container, and an easy-open member positioned between the product-receiving compartment and the distal edges of the container. The easy-open member has a frangible portion of the lidding film which forms a tab member when punctured, for example by the force of a human finger, to provide a means for removing the lidding film from the flange and gaining access to the product-receiving compartment.

22 Claims, 6 Drawing Sheets

EASY-OPEN PACKAGE

FIELD OF THE INVENTION

The present invention generally relates to packaging containers including both a product-receiving compartment and a peelable film, and particularly, to packaging containers which have an easy-open feature.

BACKGROUND OF THE INVENTION

Packaging containers which combine a product-receiving compartment with a peelable lidding provide consumers with a convenient means to open the container without the use of scissors, knives or other cutting implements. Typically, such packaging containers are opened by first gripping a portion of the lidding that extends beyond the perimeter of the product-receiving compartment, and then peeling back the lidding. It would be desirable to provide a packaging container having an easy-open feature.

SUMMARY OF THE DISCLOSURE

The present invention provides a rigid or semi-rigid tray comprising a bottom and at least one side wall which forms at least one recessed product-receiving compartment, and a flange extending around the tray which forms distal edges of the container; a lidding film affixed to the flange which forms a peelable heat-seal extending around the product-receiving compartment and the distal edges of the container; and an easy-open member positioned between the product-receiving compartment and the distal edges of the container, and comprising a frangible portion of the lidding film which forms a tab member when punctured, for example by the force of a human finger, to provide a means for removing the lidding film from the flange and gaining access to the product-receiving compartment.

As a first aspect, the present disclosure is directed to an easy-open packaging container comprising a tray comprising at least one recessed product-receiving compartment and a flange extending around the tray which forms distal edges of the container, a lidding film affixed to the flange which forms a peelable heat-seal extending around the product-receiving compartment and the distal edges of the container, and an easy-open member positioned between the product-receiving compartment and the distal edges of the container. The easy-open member comprises a frangible portion of the lidding film and an aperture in the flange positioned below the frangible portion of the lidding film. The frangible portion of the lidding film forms a tab member when punctured to provide a means for removing the lidding film from the flange and gaining access to the at least one recessed product-receiving compartment.

As a second aspect, the present disclosure is directed to an easy-open packaging container comprising a tray comprising at least one recessed product-receiving compartment and a flange extending around the tray which forms distal edges of the container, a lidding film affixed to the flange which forms a peelable heat-seal extending around the product-receiving compartment and the distal edges of the container, and an easy-open member positioned between the product-receiving compartment and the distal edges of the container. The easy-open member comprises a frangible portion of the lidding film and a recessed cavity in the flange positioned below the frangible portion of the lidding film. The frangible portion of the lidding film forms a tab member when punctured to provide a means for removing the lidding film from the flange and gaining access to the at least one recessed product-receiving compartment.

As a third aspect, the present disclosure is directed to an easy-open packaging container comprising a tray comprising at least one recessed product-receiving compartment and a flange extending around the tray which forms distal edges of the container, a lidding film affixed to the flange which forms a peelable/resealable heat-seal extending around the product-receiving compartment and the distal edges of the container, and an easy-open member positioned between the product-receiving compartment and the distal edges of the container. The easy-open member comprises a frangible portion of the lidding film. The frangible portion of the lidding film forms a tab member when punctured to provide a means for removing the lidding film from the flange and gaining access to the at least one recessed product-receiving compartment. The lidding film may be repeatedly peeled from and resealed to the flange.

DETAILED DESCRIPTION OF THE DISCLOSURE

Figure 1:
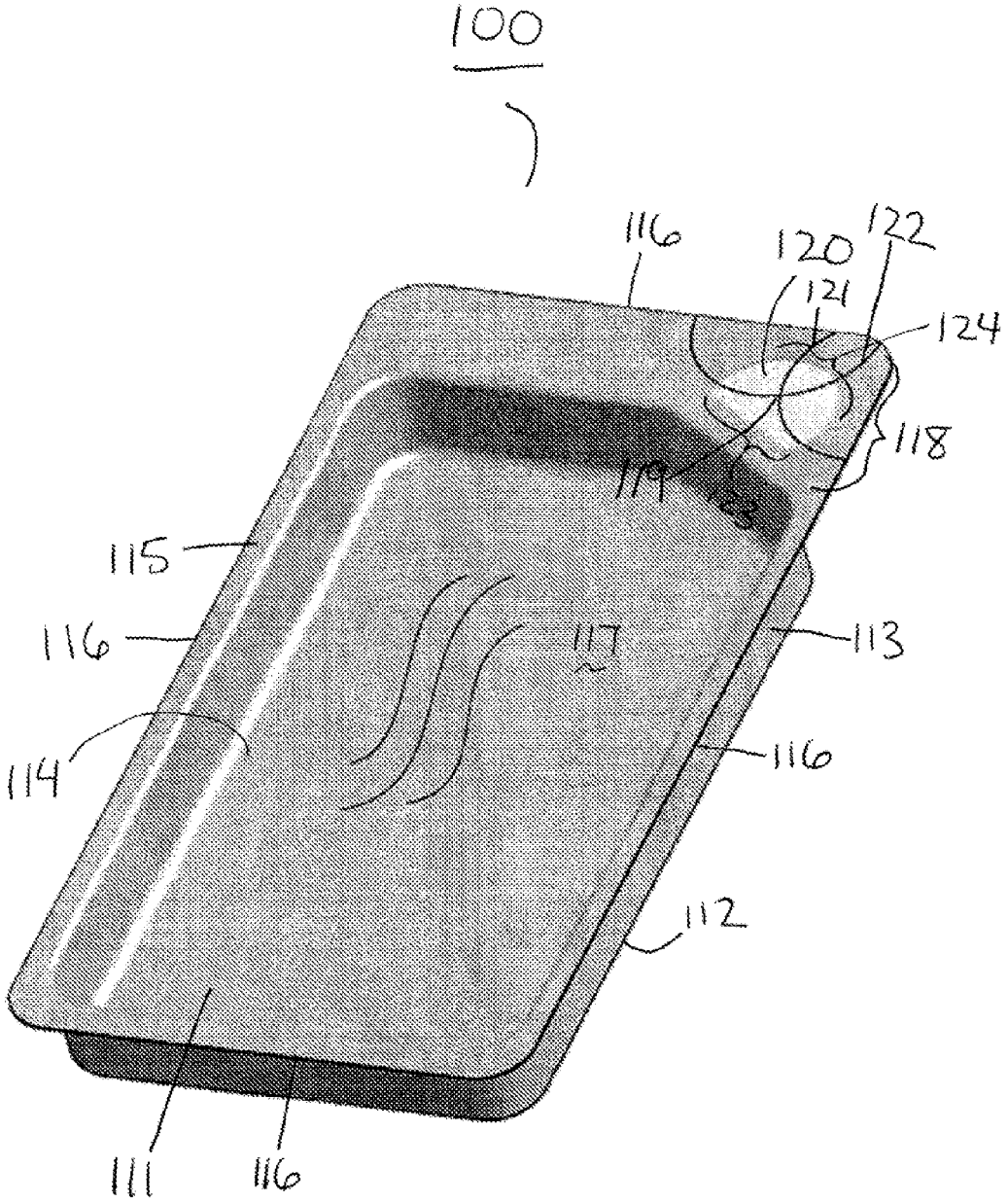
FIG. 1 shows a perspective view of a packaging container having a tray comprising a flange including an aperture and a peelable lidding comprising a frangible portion affixed to the flange, according to the present disclosure.

As used herein, the term "film" is use in the generic to include plastic web, regardless of whether it is a film or sheet.

As used herein, the term "thermoplastic" refers to a polymer or polymer mixture that softens when exposed to heat and then returns to its original condition when cooled to room temperature. In general, thermoplastic materials include, but are not limited to, synthetic polymers such as polyolefins, polyesters, polyamides, polystyrenes, and the like. Thermoplastic materials may also include any synthetic polymer that is cross-linked by either radiation or chemical reaction during the manufacturing or post manufacturing process operation.

As used herein, the term "polymer" refers to a material which is the product of a polymerization or copolymerization reaction of natural, synthetic, or natural and synthetic monomers and/or comonomers, and is inclusive of homopolymers, copolymers, terpolymers, etc. In general, the layers of a film of the present invention may comprise a single polymer, a mixture of a single polymer and non-polymeric material, a combination of two or more polymer materials blended together, or a mixture of a blend of two or more polymer materials and non-polymeric material. It will be noted that many polymers may be synthesized by the mutual reaction of complementary monomers. It will also be noted that some polymers are obtained by the chemical modification of other polymers such that the structure of the macromolecules that constitute the resulting polymer can be thought of as having been formed by the homopolymerization of a hypothetical monomer.

As used herein, the term "copolymer" refers to a polymer product obtained by the polymerization reaction or copolymerization of at least two monomer species. Copolymer may also be referred to as bipolymers. The term "copolymer" is also inclusive of the polymerization reaction of three, four or more monomer species having reaction products referred to terpolymers, quaterpolymers, etc. As used herein, a copolymer identified in terms of a plurality of monomers, e.g., ethylene/propylene copolymer, refers to a copolymer in which either monomer may copolymerize in a higher weight or molar percent than the other monomer or monomers. It is appreciated by a person of ordinary skill in the art that the term "copolymer," as used herein, refers to those copolymers where the first listed comonomer is polymerized in a higher weight percent than the second listed comonomer.

As used herein, terminology employing a "/" with respect to the chemical identity of any copolymer, e.g., an ethylene/unsaturated ester copolymer, identifies the comonomers which are copolymerized to produce the copolymer.

As used herein, the phrase "polyolefin" refers to homopolymers and copolymers having a methylene linkage between monomer units which may be formed by any method known to a person of ordinary skill in the art. An example of a polyolefin includes polyethylene (PE) which includes, but is not limited to, low-density polyethylene (LDPE), linear low-density polyethylene (LLDPE), very low-density polyethylene (VLDPE), ultra low-density polyethylene (ULDPE), medium-density polyethylene (MDPE), high-density polyethylene (HDPE), ultra high-density polyethylene (UHDPE), and polyethylenes comprising ethylene/α-olefin copolymers (E/AO). These ethylene/α-olefin copolymers are copolymers of ethylene with one or more α-olefins (alpha-olefins) such as butene-1, hexene-1, octene-1, or the like as a comonomer. Other examples of polyolefin include cyclic olefin copolymers (COC), ethylene/propylene copolymers (PEP), polypropylene (PP), propylene/ethylene copolymer (PPE), polyisoprene, polybutylene (PB), polybutene-1, poly-3-methylbutene-1, poly-4-methylpentene-1, and propylene/α-olefins (P/AO) which are copolymers of propylene with one or more α-olefins (alpha-olefins) such as butene-1, hexene-1, octene-1, or the like as a comonomer. Exemplary of commercially available polyethylenes suitable for use in the present invention include, but are not limited to, the linear low-density polyethylene family of resins supplied by ExxonMobil Chemical Company, Houston, Tex., U.S.A. A particularly suitable grade includes, but is not limited to, for example, ExxonMobil ESCORENE® LLDPE LL1001.32 having a melt index of 1.0 dg/min., a density of 0.918 g/cm$^3$, and a melting point of 121° C. An example of a commercially available polypropylene suitable for use in the present invention is sold under the trademark BP Amoco ACCLEAR® 6219 from Innovene, Chicago, Ill., U.S.A. Exemplary of commercially available cyclic olefin copolymers suitable for use in the present invention include, but are not limited to, the TOPAS® family of resins, e.g., TOPAS® 8007 grade having a glass transition temperature of 80° C., a tensile strength of 9600 psi, and a tensile modulus of 377,000 psi, which is supplied by Celanese-Ticona, Summit, N.J., U.S.A.

As used herein, the phrase "modified polyolefin", refers to a chemical derivative of a polyolefin, e.g., a polyolefin having any form of anhydride functionality, such as anhydride of maleic acid, crotonic acid, citraconic acid, itaconic acid, fumaric acid, etc., whether grafted onto a polymer, copolymerized with a polymer, or blended with one or more polymers. Exemplary of commercially available anhydride-modified polyolefins suitable for use in the present invention include, but are not limited to, the BYNEL® family of resins, e.g., BYNEL® 41E687 grade having melt index of 1.7 dg/min. (at 190° C.), a density of 0.91 g/cm$^3$, a melting point of 119° C., which is supplied by du Pont de Nemours and Company, Wilmington, Del., U.S.A.

As used herein, the term "ionomer" refers to an ionic copolymer formed from an olefin and an ethylenically unsaturated monocarboxylic acid having the carboxylic acid moieties partially neutralized by a metal ion. Suitable metal ions may include, but are not limited to, potassium, lithium, cesium, nickel, zinc and preferably sodium. Suitable carboxylic acid comonomers may include, but are not limited to, ethylene/methacrylic acid, methylene succinic acid, maleic anhydride, vinyl acetate/methacrylic acid, methyl/methacrylate/methacrylic acid, styrene/methacrylic acid and combinations thereof. Useful ionomer resins may include an olefinic content of at least 50% (mol.) based upon the copolymer and a carboxylic acid content of between 5-25% (mol.) based upon the copolymer. Useful ionomers are also described in U.S. Pat. No. 3,355,319 to Rees, which is incorporated herein by reference in its entirety. Exemplary of commercially available ionomers suitable for use in the present invention include, but are not limited to, the SURLYN® family of resins, e.g., SURLYN® 1601 grade having a density of 0.940 g/cm$^3$, a melt flow index of 1.30 dg/min. (at 190° C.), a Vicat softening point of 73.9° C., which is supplied by du Pont de Nemours and Company, Wilmington, Del., U.S.A.

The phrase "glass transition temperature" as used herein means the temperature at which a polymer changes from an amorphous glassy state to a rubbery state, and in the transition region, various properties such as an elastic modulus, an expansion coefficient, a heat content, a refractive index, a dielectric constant, and so forth, are changed. The glass transition temperature can be measured from the change of these properties, but more definitely, this can be evaluated by a known method by using differential scanning calorimetry (DSC) or dynamic mechanical analysis (DMA). When measuring the glass transition temperature by the differential scanning calorimetry, the glass transition temperature can be determined by ASTM D-3417 test method, which is incorporated herein by reference. Alternatively, ASTM E-1640-04 test method may be used to determine the glass transition temperature by dynamic mechanical analysis, the disclosure of which is incorporated herein by reference.

As used herein, the terms "coextruded" or "coextrusion" refer to the process of extruding two or more polymer materials through a single die with two or more orifices arranged so that the extrudates merge and weld together into a laminar structure before chilling, i.e., quenching. The films according to the present invention may be fabricated by any coextrusion method known to a person of ordinary skill in the art which may be include, but is not limited to, for example, blown film coextrusion, slot cast coextrusion, and extrusion coating, preferably, slot cast and single-bubble blown film, and more preferably, single-bubble blown film.

As used herein, the phrase "interior film layer," as applied to film of the present invention, refers to any film layer having both its principal surfaces directly adhered to another layer of the film. In contrast, the phrase "exterior film layer" refers to any film layer having less than two of its principal surfaces directly adhered to another layer of the film.

As used herein, the phrase "direct contact and bonded" as applied to film layers of the present invention, defines a subject film layer having face-to-face contact to another film layer (presumably, over their entire planar surfaces).

As used herein, the term "heat-seal" refers to both a film layer which is heat sealable to itself or other thermoplastic film layer, and the formation of a fusion bond between two polymer surfaces by conventional indirect heating means. It will be appreciated that conventional indirect heating generates sufficient heat on at least one film contact surface for conduction to the contiguous film contact surface such that the formation of a bond interface therebetween is achieved without loss of the film integrity.

As used herein, the phrase "ethylene/vinyl alcohol copolymer" refers to hydrolyzed copolymers of ethylene and vinyl acetate monomers. Ethylene/vinyl alcohol copolymers can be represented by the general formula: $[(CH_2—CH_2)_m—(CH_2—CH(OH))_n]$. Exemplary of commercially available ethylene/vinyl alcohol copolymers suitable for use in the present invention include, but are not limited to, the SOARNOL® family of resins, e.g., SOARNOL® ET3803 grade having a reported bulk density of 0.64-0.74 g/cm$^3$, a relative density of 1.13-1.22 g/cm$^3$, a melting point of 164-188° C., which may be obtained from The Nippon Synthetic Chemical Industry Company, Ltd. (Nippon Gohsei), Osaka, Japan.

As used herein, the term "polyester" refers to homopolymers or copolymers having an ester linkage between monomer units which may be formed, for example, by condensation polymerization reactions between a dicarboxylic acid and a diol. The ester linkage can be represented by the general formula: $[R—C(O)O—R']_n$ where R and R'=the same or different alkyl group and may be generally formed from the polymerization of dicarboxylic acid and diol monomers or monomers containing both carboxylic acid and hydroxyl moieties. The dicarboxylic acid may be linear or aliphatic, i.e., lactic acid, oxalic acid, maleic acid, succinic acid, glutaric acid, adipic acid, pimelic acid, suberic acid, azelaic acid, sebacic acid, and the like; or may be aromatic or alkyl substituted aromatic, i.e., various isomers of phthalic acid, such as paraphthalic acid (or terephthalic acid), isophthalic acid and naphthalic acid. Specific examples of alkyl substituted aromatic acids include the various isomers of dimethylphthalic acid, such as dimethylisophthalic acid, dimethylorthophthalic acid, dimethylterephthalic acid, the various isomers of diethylphthalic acid, such as diethylisophthalic acid, diethylorthophthalic acid, the various isomers of dimethylnaphthalic acid, such as 2,6-dimethylnaphthalic acid and 2,5-dimethylnaphthalic acid, and the various isomers of diethylnaphthalic acid. The glycols may be straight-chained or branched. Specific examples include ethylene glycol, propylene glycol, trimethylene glycol, 1,4-butane diol, neopentyl glycol and the like. The polyalkyl terephthalates are aromatic esters having a benzene ring with ester linkages at the 1,4-carbons of the benzene ring as compared to polyalkyl isophthalate, where two ester linkages are present at the 1,3-carbons of the benzene ring. In contrast, polyalkyl naphthalate are aromatic esters having two fused benzene rings where the two ester linkages may be present at the 2,3-carbons or the 1,6-carbons. Exemplary of commercially available polyethylene terephthalates (PET) suitable for use in the present invention include, but are not limited to, the EASTAPAK®, EASTPAK® and EASTAR® families of resins which are all supplied from Eastman Chemical Company, Kingsport, Tenn., U.S.A. A particularly suitable grade of the EASTAR® polyethylene terephthalate (PET) is EASTAR® 6763 polyethylene terephthalate copolymer, which is a copolymer formed from terephthalic acid, ethylene glycol and cyclohexane dimethanol, and has glass transition temperature of 80° C., a tensile modulus of 300,000 psi, a flexural modulus of 300,000 psi, and a reported density of about 1.27 g/cm$^3$.

As used herein, the term "polyamide" and "nylon" refer to homopolymers or copolymers having an amide linkage between monomer units which may be formed by any method known to those skilled in the art. The amide linkage can be represented by the general formula: $[R—C(O)N—R']_n$ where R and R'=the same or different alkyl group. Useful polyamide homopolymers include nylon 6 (polycaprolactam), nylon 11 (polyundecanolactam), nylon 12 (polyauryllactam), and the like. Other useful polyamide homopolymers also include nylon 4,2 (polytetramethylene ethylenediamide), nylon 4,6 (polytetramethylene adipamide), nylon 6,6 (polyhexamethylene adipamide), nylon 6,9 (polyhexamethylene azelamide), nylon 6,10 (polyhexamethylene sebacamide), nylon 6,12 (polyhexamethylene dodecanediamide), nylon 7,7 (polyheptamethylene pimelamide), nylon 8,8 (polyoctamethylene suberamide), nylon 9,9 (polynonamethylene azelamide), nylon 10,9 (polydecamethylene azelamide), nylon 12,12 (polydodecamethylene dodecanediamide), and the like. Useful polyamide copolymers include nylon 6,6/6 copolymer (polyhexamethylene adipamide/caprolactam copolymer), nylon 6,6/9 copolymer (polyhexamethylene adipamide/azelaiamide copolymer), nylon 6/6,6 copolymer (polycaprolactam/hexamethylene adipamide copolymer), nylon 6,2/6,2 copolymer (polyhexamethylene ethylenediamide/hexamethylene ethylenediamide copolymer), nylon 6,6/6,9/6 copolymer (polyhexamethylene adipamide/hexamethylene azelaiamide/caprolactam copolymer), as well as other nylons which are not particularly delineated here. Exemplary of even more suitable polyamides include nylon 4,I, nylon 6,I, nylon 6,6/6I copolymer, nylon 6,6/6T copolymer, MXD6 (poly-m-xylylene adipamide), nylon 6T/6I copolymer, nylon 6/MXDT/I copolymer, nylon MXDI, poly-p-xylylene adipamide, polyhexamethylene terephthalamide, polydodecamethylene terephthalamide and the like. The generic source-based nomenclature convention is used to name the hereinabove nylon polymers and copolymers. See "Generic Source-Based Nomenclature for Polymers," *Pure Applied Chemistry*, Vol. 73, No. 9, pp. 1511-1519 (International Union of Pure and Applied Chemistry 2001). Exemplary of commercially available polyamides suitable for use in the present invention include, but are not limited to, the ULTRAMID® family of resins supplied by BASF, Mount Olive, N.J., U.S.A. and ZYTEL® family of resins provided by du Pont de Nemours and Company, Wilmington, Del., U.S.A. A particularly suitable grade of the ULTRAMID® polyamide includes ULTRAMID® B36 nylon 6 having a glass transition temperature of 127" C., a density of 1.13 g/cm$^3$, and tensile strength (at yield) of 131,000 psi.

As used herein, the term "polystyrene" refers to homopolymers and copolymers having at least one styrene monomer (benzene, i.e., $C_6H_5$, having an ethylene substituent) linkage within the repeating backbone of the polymer. The styrene linkage can be represented by the general formula: $[(C_6R_5)CH_2CH_2]_n$ where R=H or an alkyl group. Polystyrene may be formed by any method known to those skilled in the art. Suitable polystyrene include, for example, but are not limited to, oriented polystyrene (OPS) film and resins, i.e., polystyrene (PS), syndiotactic polystyrene (SPS), acrylonitrile-butadiene-styrene (ABS), styrene-acrylonitrile (SAN), ethylene/styrene copolymers, styrene/acrylic copolymers, styrene block copolymers (SBC), and the like. Exemplary of commercially available polystyrenes suitable for use in the present invention include, but are not limited to, POLYSTYRENE® 535 having a tensile modulus of 430,000, a flexural modulus of 450,000 which is supplied by Total Petrochemicals USA, Inc., Houston, Tex., U.S.A.

As used herein, the phrase "tacky pressure-sensitive adhesive" refers to adhesives which may be used to affix the surface of one film layer to the surface of another film layer with application of manual pressure. Preferably, the tacky pressure-sensitive adhesive may also allow one surface to be removed and/or repositioned from the other surface. Pressure-sensitive adhesives may include a combination of a tackifier first component and an elastomer second component of rubber, acrylic, silicone, or blends thereof. These pressure-sensitive adhesives are known in the art and are described in U.S. Pat. Nos. 4,673,601 and 5,089,320, which are incorporated herein by reference in their entireties. Preferably, the pressure-sensitive adhesive may comprises both a tackifier and an elastomer of styrene/rubber copolymer. A particular suitable tacky pressure-sensitive adhesive for use in the present invention includes, but is not limited to, for example, a material having a density of 0.96 g/cm$^3$ which is sold under the product name FINDLEY® M3156 from Bostik Findley, Inc., Wauwatosa, Wis., U.S.A.

As used herein, the phrase "styrene/rubber copolymer" refers to block copolymers including di-block, tri-block, radial block, multi-block and mixtures thereof of styrene and rubber. Suitable rubber segment of styrene/rubber copolymers may include, but are not limited to, butadiene, isoprene, butylene, ethylene-butylene, propylene, ethylene-propylene, ethylene and blends thereof. Exemplary styrene/rubber copolymers which are commercially available include styrene/rubber copolymers sold under the trademark KRATON® by Kraton Polymers, Houston, Tex., U.S.A. Styrene/rubber copolymers are fully disclosed in U.S. Pat. No. 5,221,534, the disclosure of which is incorporated herein by reference. As used herein, the term "tackifier" is generally an adhesive additive which serves to modify the rheological properties of the final adhesive. Specifically, a tackifier resin is used to improve the tack of the adhesive composition. As used herein, the term "tack" refers to the "stickiness" of the adhesive or its resistance to removal or deformation from a substrate. The tackifier may comprise any suitable material, preferably, a hydrocarbon resin material or mixtures thereof. Exemplary tackifiers are ESCOREZ® 1102, ESCOREZ® 1304, ESCOREZ® 1315, available from ExxonMobil Chemical Company, Houston, Tex., U.S.A.; WINGTAK® resins available from Sartomer Company, Inc., Exton, Pa., U.S.A.; PICCOTAC® 1100 and POLYPALE® 100 available from Eastman Chemicals, Kingsport, Tenn., U.S.A.

As used herein, the phrase "peel strength" refers to the force required to separate at least a portion of the interface between two adjoining interior film layers when the film has been sealed to a second thermoplastic film. The peel strength may depend on the chemical similarity or dissimilarity of the two film layers and their individual thickness. Peel strength may also be affected by the composition and thickness of adjacent film layers which are ruptured during the separation of the interface. Peel strength may still further be affected by environmental conditions during film fabrication, the packaging process and whether there has been an initial separation of the interface and the number of times the interface has been separated and resealed. One method for determining bond strength is ASTM F-904 test method entitled, "Standard Test Method for Comparison of Bond Strength or Ply Adhesion of Similar Laminates Made from Flexible Materials" and published by ASTM International, West Conshohocken, Pa., U.S.A., which is herein incorporated by reference in its entirety. Peel strengths may be determined in accordance with ASTM F-904 test method, including a modification to the test procedure. The modification entails preparing test specimens by heat-sealing the surface of the subject film along its entire length to a second thermoplastic film with an end-portion of the subject film unsealed to the second film. With the test specimens prepared in this manner, the unsealed end-portion of the subject film is then peeled from the second film at an angle of at 180° relative to the second film.

With reference to the drawings, there is seen in FIG. 1 an easy-open packaging container 100 comprising a rigid or semi-rigid tray 111 comprising a bottom 112 and at least one side wall 113 which forms at least one recessed product-receiving compartment 114, and a flange 115 extending around said tray 111 which forms distal edges 116 of said container. The packaging container further comprises a lidding film 117 affixed to said flange 115, which forms a peelable heat-seal extending around said product-receiving compartment 114 and said distal edges 116 of said container. Accordingly, said lidding film 117 is peelably heat-sealed to said flange 115. An easy-open member 118 is positioned between said product-receiving compartment 114 and said distal edges 116 of said container. The easy-open member 118 comprises a frangible portion 119 of said lidding film which forms a tab member when punctured to provide a means for removing said lidding film 117 from said flange 115 and gaining access to said product-receiving compartment 114. In certain embodiments of the present invention, the easy-open member 118 defines an aperture 120 positioned below said frangible portion 119 of said lidding film. In alternate embodiments of the invention, the container comprises a continuous easy-open member, which does not comprise any apertures.

According to an embodiment of the invention, the frangible portion 119 of said lidding film remains unsealed to said flange, whereas the other portions of said lidding film 117 are heat-sealed to said flange 115. The frangible portion 119 of said lidding film may be made frangible by any convenient means, such as by providing at least one line of weakness in said frangible portion 119 of said lidding film. As depicted, the frangible portion 119 of said lidding film comprises two lines of weakness 121, 122. The lines of weakness 121, 122 may be formed using any suitable instrument, for example and without limitation, a laser or a blade. According to certain aspects, a laser, such as an infrared laser, is employed to form the lines of weakness 121, 122. A lidding film may be transported past the laser, for example, at a selected line speed, and the laser will cut a desired scoring pattern into the one or more layers of the film to form at least one line of weakness.

It will be appreciated by those of skill in the art that the at least one line of weakness will be configured such that the frangible portion of the lidding film remains intact, secure and unbroken during package fabrication, distribution and storage, but is also easily broken when it is desired to open the packaging container. In particular, the composition of the lidding film is selected, and the at least one line of weakness are preferably configured, such that the force required to puncture the frangible portion is less than about 20 Newton as measured in accordance with ASTM F-1306-90 test method. For example, the force required to puncture the frangible portion is between about 0.5 Newton and about 20 Newton, or between about 1 Newton and about 20 Newton, or between about 5 Newton and about 20 Newton, or between about 10 Newton and about 20 Newton, or between about 15 Newton and about 20 Newton. The selection of such ranges of force allows the frangible portion to be broken via application of an element on the frangible portion, for example, by the force of a human finger.

The amount of force required to puncture the frangible portion of a specific lidding film will depend on the polymeric structure and thickness of the lidding film in combination with the particular design and depth of the at least one line of weakness. According to aspects of the current invention, the length of each of the at least one lines of weakness is at least about 0.25 inches. Optionally, the length of each of the at least one lines of weakness is between about 0.25 inches and about 3.5 inches, or between about 0.25 inches and about 3 inches, or between about 0.25 inches and about 2.5 inches, or between about 0.5 inches and about 2 inches, or between about 0.5 inches and about 1.5 inches. It will be apparent to those of ordinary skill in the art that the at least one line of weakness provided in the lidding film may comprise numerous different designs to form a suitable tab member, in accordance with embodiments of the invention. For example and without limitation, in an embodiment each of the at least one line of weakness provided in the lidding film comprises a substantially straight line. In such an aspect, more than one of the substantially straight lines are positioned to intersect each other, for instance in a shape of a plus sign or an "X". In another aspect, the at least one line of weakness comprises a discontinuous line (e.g., dotted line).

According to aspects of the current invention, the depth of the scoring for each of the at least one lines of weakness is at least about 10% of the total thickness of lidding film, such as between about 10% and about 75% of the total thickness of lidding film, or between about 10% and about 60% of the total thickness of lidding film, or between about 25% and about 50% of the total thickness of lidding film, or between about 10% and about 40% of the total thickness of lidding film. Achievement of a desired puncture force by optimizing the variable features of the lidding film and the variable features of the at least one line of weakness will be within the ability of one of skill in the art, given benefit of the present disclosure.

It will be appreciated by those of skill in the art that the flange 115 may comprise any suitable width. In one aspect of the invention, the flange 115 comprises a first area 123 adjacent to the product-receiving compartment 114, said first area 123 having a width of at least about 0.25 inches. Said flange 115 further comprises a second area 124 adjacent to said distal edges 116 of the container, said second area 124 having a width of at least about 0.25 inches. The specific width selected for each area is not particularly limited. In certain aspects and as depicted in FIG. 1, each of the first area 123 and the second area 124 is a part of the easy-open member 118 and comprises a width that is sufficiently wide to accommodate an element, for instance the end of a human finger, which is employed to puncture the frangible portion 119 of said lidding film. Moreover, according to an embodiment, the width in at least one direction of the frangible portion 119 of said lidding film ranges from about 0.25 inches to about 3 inches, or from about 0.25 inches to about 2 inches, or from about 0.25 inches to about 1 inch.

The rigid or semi-rigid tray employed in embodiments of the present invention may be any suitable thermoplastic tray known in the art. For instance, the rigid or semi-rigid tray may comprise a monolayer film or a multilayer film, which is subjected to thermoforming processing. The rigid or semi-rigid tray may comprise a multilayer material which can contain functional layers, such as barriers to moisture and gases, and include a flange that can act as a sealing layer compatible with a wide variety of lidding structures. The width of the flange is limited only in that the flange must be at least sufficiently wide to be capable of forming a heat-seal with the package lidding film, the heat-seal exhibiting a seal strength of between of between 0.5-9 pound-force per linear inch (0.09-4.1 kilogram-force per linear centimeter) as measured in accordance with ASTM F-904 Test Method. According to certain embodiments, the rigid or semi-rigid tray employed in the present invention comprises a single product-receiving compartment, whereas according to alternate embodiments the tray comprises a plurality of recessed product-receiving compartments, such as two compartments, or three compartments, or four compartments, or five compartments. Any number of recessed product-receiving compartments may be provided in the rigid or semi-rigid tray as suitable for the particular use for which the container is designed.

As noted above, according to certain aspects of the invention the easy-open member defines an aperture, or comprises a recessed cavity, which is located below the frangible portion of the lidding film. It will be appreciated by those of skill in the art that the shape of such an aperture or recessed cavity is not particularly limited. As depicted in FIG. 1, the aperture 120 is illustrated to comprise the shape of a truncated circle. Any suitable shape for the aperture or recessed cavity may be formed in the semi-rigid or rigid tray during thermoforming of the container. For example and without limitation, the aperture or recessed cavity may comprise the shape of a circle, an oval, a triangle, a square, a diamond, a rectangle, a trapezoid, an octagon, a free-form shape, or the like.

The rigid or semi-rigid tray is preferably comprised of materials or a blend of materials selected from those material conventionally used in thermoforming, such as polyvinyl chloride, polyester, copolyester, high impact polystyrene, polystyrene, polypropylene, copolymers of polypropylene, high density polyethylene, polybutylene terephthalate, styrene-butadiene copolymers, polyacrylonitrile copolymers, polycarbonate, polymethylmethacrylate, and blends or composites of the above materials including blends with other various polymeric, organic, or inorganic materials as are known to those skilled in the art. Other materials that may be included in the rigid or semi-rigid tray, include materials selected from the family of sealant materials such as polyolefins including copolymers of polyethylene, such as polyethylene vinyl acetate, and sealants based on coating technology such as polyvinylidene chloride and copolymers of polyvinylidene chloride, waxes, acrylics, and a wide variety of other materials known to those skilled in the art.

The peelable lidding film employed in embodiments of the present invention may be any suitable peelable lidding film known in the art, such as a monolayer film or a multilayer film. For instance, a thermoplastic film having a film structure comprising at least a first polymer layer that includes an ethylene/unsaturated ester copolymer, wherein the first layer is an exterior film layer which is free of both polybutylene and an ionomer resin. The ethylene/unsaturated ester copolymer may comprise any ethylene/unsaturated ester copolymer or derivative thereof, preferably a material selected from the group consisting of ethylene/methyl acrylate copolymer, ethylene/methyl methacrylate copolymer, ethylene/ethyl acrylate copolymer, ethylene/ethyl methacrylate copolymer, ethylene/butyl acrylate copolymer, ethylene/2-ethylhexyl methacrylate copolymer, ethylene/vinyl acetate copolymer, and blends thereof, and more preferably an ethylene/vinyl acetate copolymer or blends thereof. The first polymer layer includes a first surface and an opposing second surface wherein the first surface has a surface tension of between 36-60 dynes/cm, preferably 40-56 dynes/cm as measured in accordance with ASTM D-2578-84 Test Method, which is incorporated herein by reference in its entirety. The thermoplastic film is adapted to form a peelable seal between the first surface of the first layer and a polyester substrate, for example, by pressure of less than $1\times10^5$ Pa applied therebetween. The peelable seal may exhibit a seal strength of between 0.5-9 pound-force per linear inch (0.09-4.1 kilogram-force per linear centimeter) as measured in accordance with ASTM F-904 Test Method, which is incorporated herein by reference in its entirety. Numerous nonlimiting examples of suitable peelable films are described in co-owned U.S. Application Publication No. 2006/0269707 and U.S. Reissue Pat. No. RE 37,171, the disclosure of each of which is incorporated by reference herein in its entirety.

Figure 2:
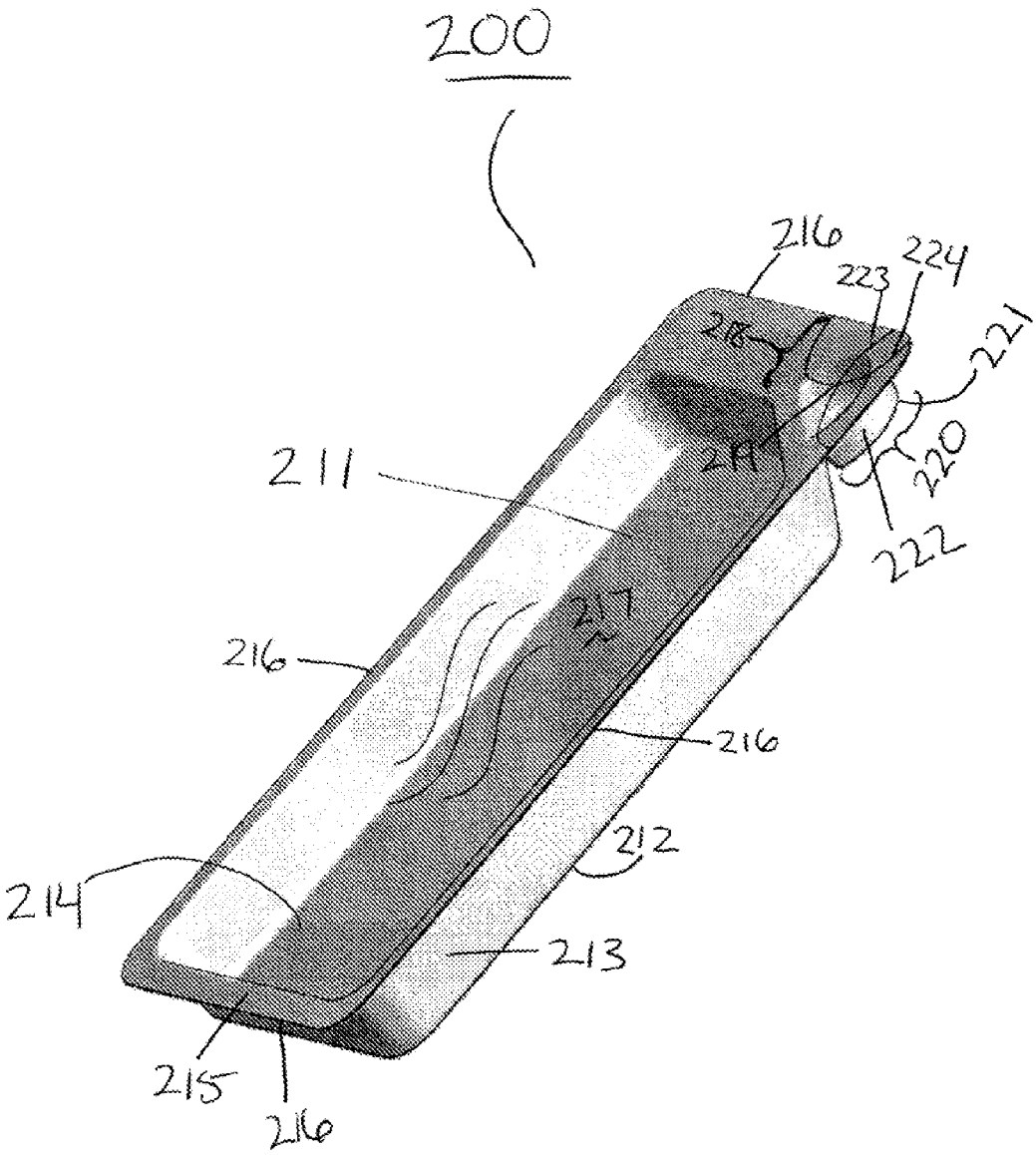
FIG. 2 shows a perspective view of a packaging container having a tray comprising a flange including a recessed cavity and a peelable lidding comprising a frangible portion affixed to the flange, according to the present disclosure.

Turning to FIG. 2, an easy-open packaging container 200 is presented; comprising a rigid or semi-rigid tray 211 comprising a bottom 212 and at least one side wall 213 which forms at least one recessed product-receiving compartment 214, and a flange 215 extending around said tray 211 which forms distal edges 216 of said container. The packaging container 200 further comprises a lidding film 217 affixed to said flange 215, which forms a peelable heat-seal extending around said product-receiving compartment 214 and said distal edges 216 of said container. Accordingly, said lidding film 217 is peelably heat-sealed to said flange 215. An easy-open member 218 is positioned between said product-receiving compartment 214 and said distal edges 216 of said container. The easy-open member 218 comprises a frangible portion 219 of said lidding film 217 which forms a tab member when punctured to provide a means for removing said lidding film 217 from said flange 215 and gaining access to said product-receiving compartment 214. As depicted, the easy-open member 218 defines a recessed cavity 220 positioned below said frangible portion 219 of said lidding film. The recessed cavity 220 comprises a bottom 221 and at least one side wall 222. The frangible portion 219 of said lidding film may be made frangible by any convenient means, such as by providing at least one line of weakness in said frangible portion 219 of said lidding film. As depicted, the frangible portion 219 of said lidding film comprises two lines of weakness 223, 224.

Figure 3:
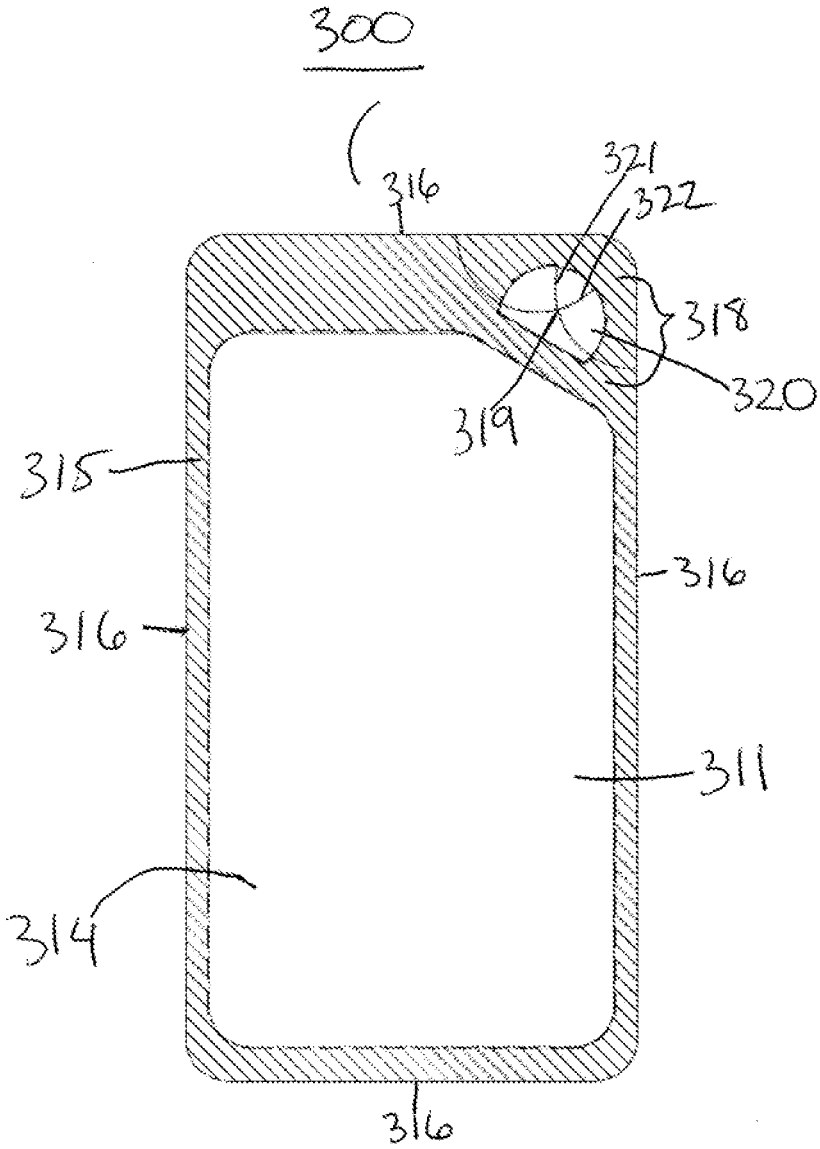
FIG. 3 shows a top view of a packaging container having a tray comprising a flange and a peelable lidding comprising a frangible portion affixed to the flange, according to the present disclosure, wherein the lidding is heat-sealed to substantially the entire surface of the flange.

In FIG. 3, a top view is provided of an easy-open packaging container 300 comprising a rigid or semi-rigid tray 311 comprising at least one recessed product-receiving compartment 314 and a flange 315 extending around said tray 311 which forms distal edges 316 of said container. The packaging container 300 further comprises a lidding film 317 affixed to said flange 315, which forms a peelable heat-seal extending around said product-receiving compartment 314 and said distal edges 316 of said container. Accordingly, said lidding film 317 is peelably heat-sealed to said flange 315. An easy-open member 318 is positioned between said product-receiving compartment 314 and said distal edges 316 of said container. The easy-open member 318 comprises a frangible portion 319 of said lidding film 317 which forms a tab member when punctured to provide a means for removing said lidding film 317 from said flange 315 and gaining access to said product-receiving compartment 314. Moreover, the easy-open member 318 defines an aperture 320 positioned below said frangible portion 319 of said lidding film. The frangible portion 319 of said lidding film comprises two lines of weakness 321, 322. As depicted (i.e., using diagonal hatch marks), the lidding film 317 is heat-sealed to substantially the entire surface of the flange 315.

Figure 4:
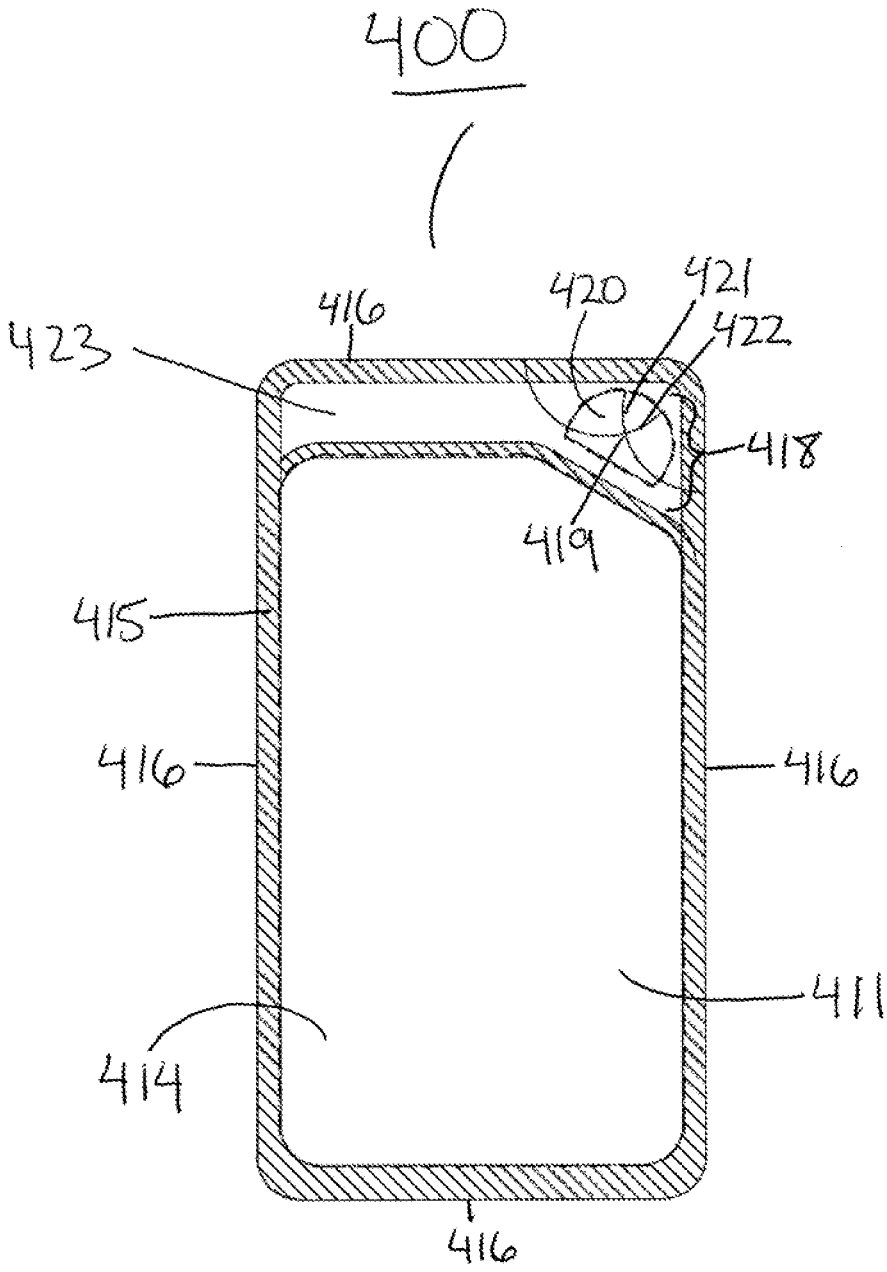
FIG. 4 shows a top view of a packaging container having a tray comprising a flange and a peelable lidding comprising a frangible portion affixed to the flange, according to the present disclosure, wherein the lidding is heat-sealed to a portion of the surface of the flange.

In contrast to FIG. 3, FIG. 4 illustrates an embodiment in which the lidding film remains unsealed to a portion of the flange. More particularly, FIG. 4 provides a top view of an easy-open packaging container 400 comprising a rigid or semi-rigid tray 411 comprising at least one recessed product-receiving compartment 414 and a flange 415 extending around said tray 411 which forms distal edges of said container 416. The packaging container 400 further comprises a lidding film 417 affixed to said flange 415, which forms a peelable heat-seal extending around said product-receiving compartment 414 and said distal edges 416 of said container. Accordingly, said lidding film 417 is peelably heat-sealed to said flange 415. An easy-open member 418 is positioned between said product-receiving compartment 414 and said distal edges 416 of said container. The easy-open member 418 comprises a frangible portion 419 of said lidding film which forms a tab member when punctured to provide a means for removing said lidding film 417 from said flange 415 and gaining access to said product-receiving compartment 414. Moreover, the easy-open member 418 defines an aperture 420 positioned below said frangible portion 419 of said lidding film. The frangible portion 419 of said lidding film comprises two lines of weakness 421, 422. As depicted (i.e., using diagonal hatch marks), the lidding film is sealed to a substantial area of the surface of the flange 415, but is unsealed to at least a portion 423 of the easy-open member 418. As used herein, the term "unsealed" is defined as remaining unattached. For instance, a portion of the lidding film may be subjected to heat sufficient for heat sealing the portion to a flange, whereas an adjacent portion of the lidding film is subjected to heat that is insufficient for heat sealing the portion to a flange, and is thus unsealed.

Figure 5:
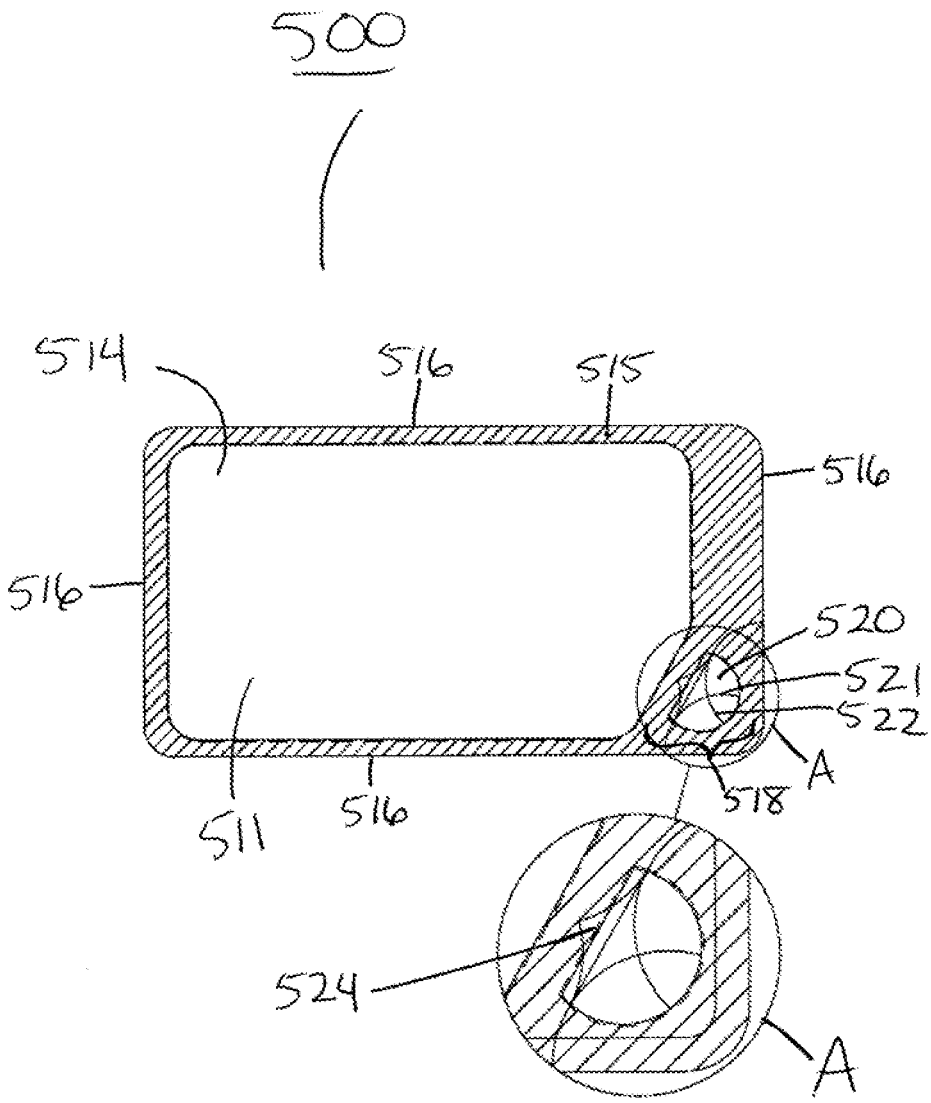
FIG. 5 shows a top view of a packaging container having a tray comprising a flange and a peelable lidding comprising a frangible portion affixed to the flange, according to the present disclosure, wherein the lidding is heat-sealed to substantially the entire surface of the flange and the frangible portion has been punctured to provide a means for removing the lidding from the flange.

Turning to FIG. 5, a top view is provided of an easy-open packaging container 500 comprising a rigid or semi-rigid tray 511 comprising at least one recessed product-receiving compartment 514 and a flange 515 extending around said tray 511 which forms distal edges 516 of said container. The packaging container further comprises a lidding film 517 affixed to said flange 515, which forms a peelable heat-seal extending around said product-receiving compartment 514 and said distal edges 516 of said container. Accordingly, said lidding film 517 is peelably heat-sealed to said flange 515. An easy-open member 518 is positioned between said product-receiving compartment 514 and said distal edges 516 of said container. The easy-open member 518 comprises a frangible portion 519 of said lidding film which forms a tab member 524 when punctured to provide a means for removing said lidding film 517 from said flange 515 and gaining access to said product-receiving compartment 514. Moreover, the easy-open member 518 defines an aperture 520 positioned below said frangible portion 519 of said lidding film. The frangible portion 519 of said lidding film comprises two lines of weakness 521, 522. As depicted (i.e., using diagonal hatch marks), the lidding film 517 is sealed to substantially the entire surface of the flange 515.

A close-up view A of a portion of the easy-open member 518 is provided in FIG. 5, in which the frangible portion 519 of said lidding film has been punctured to provide a means for removing the lidding film 517 from the flange 515. In particular, the close-up view A illustrates tab member 524 of said frangible portion 519 of said lidding film that is formed following puncturing of said frangible portion 519 of said lidding film. The specific design of the two lines of weakness 521, 522, of intersecting semi-circles, results in a tab member 524 having a pointed, triangular shape.

Figure 6:
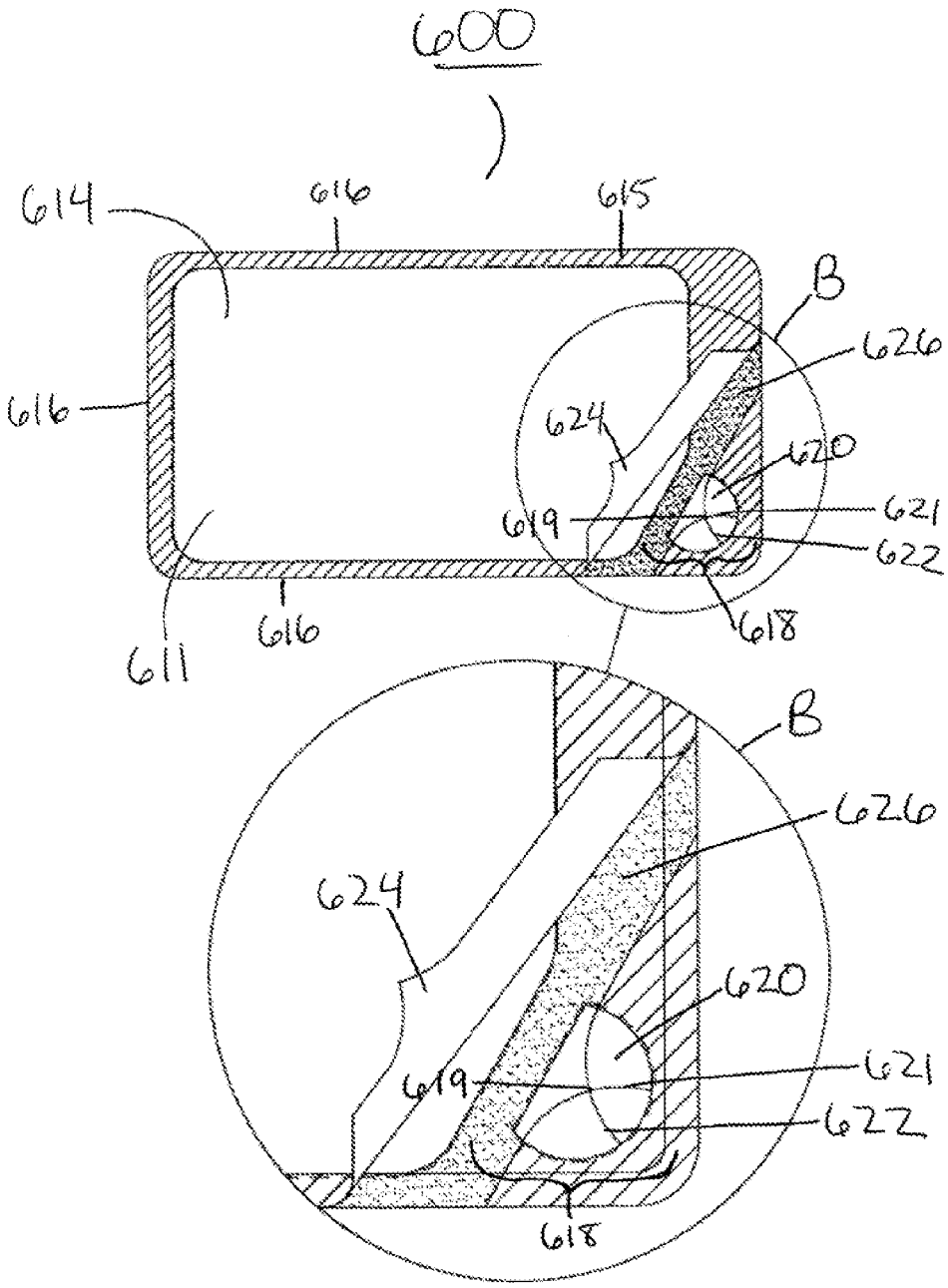
FIG. 6 shows a top view of a packaging container having a tray comprising a flange and a peelable/resealable lidding comprising a frangible portion affixed to the flange, according to the present disclosure, wherein the lidding is heat-sealed to substantially the entire surface of the flange and the frangible portion has been punctured to provide a means for removing the lidding from the flange and resealing the lidding to the flange.

FIG. 6 illustrates a top view of an easy-open packaging container 600 comprising a rigid or semi-rigid tray 611 comprising at least one recessed product-receiving compartment 614 and a flange 615 extending around said tray 611 which forms distal edges 616 of said container. The packaging container further comprises a multilayer lidding film 617 affixed to said flange 615, which forms a peelable/resealable heat-seal extending around said product-receiving compartment 614 and said distal edges 616 of said container. Accordingly, said lidding film 617 is peelably heat-sealed to said flange 615. An easy-open member 618 is positioned between said product-receiving compartment 614 and said distal edges 616 of said container. The easy-open member 618 comprises a frangible portion 619 of said multilayer lidding film which forms a tab member 624 when punctured to provide a means for removing said lidding film 617 from said flange 615 and gaining access to said product-receiving compartment 614. Moreover, the easy-open member 618 defines an aperture 620 positioned below said frangible portion 619 of said multilayer lidding film. The frangible portion 619 of said multilayer lidding film comprises two lines of weakness 621, 622. As depicted (i.e., using diagonal hatch marks), the multilayer lidding film 617 is sealed to substantially the entire surface of the flange 615.

A close-up view B of a portion of the easy-open member 618 is provided in FIG. 6, in which the frangible portion 619 of said lidding film has been punctured to provide a means for removing the multilayer lidding film 617 from the flange 615 and resealing the multilayer lidding film 617 to the flange 615. In particular, the close-up view B illustrates the tab member 624 of said frangible portion 619 of said multilayer lidding film that is formed following puncturing of said frangible portion 619 of said multilayer lidding film. The specific design of the two lines of weakness 621, 622, of intersecting semi-circles, results in a tab member 624 having a pointed, triangular shape. It will be apparent to those of ordinary skill in the art that the at least one line of weakness provided in the lidding film may comprise numerous different designs to form a suitable tab member, in accordance with embodiments of the invention. The close-up view B further illustrates the resealable aspect of the peelable/resealable multilayer lidding film 617 according to certain aspects of the invention. As depicted, the close-up view B shows the tab member 624 pulled back to reveal a polymer layer 626 that provides a resealable interface (i.e., depicted using dots). Any suitable peelable/resealable multilayer film may be employed in the packaging containers according to embodiments of the invention.

Multilayer lidding films may be considered "peelable" when the bond between two film, laminate or substrate surfaces comprise a peelable resealable interface adapted to separate by application of pulling or peeling force exerted away one substrate which has been heat-sealed to a second substrate. The force required to separate the interface may be dependent upon the chemical composition of each of the two substrate surfaces, for example, the chemical similarities or dissimilarities of the contact surface of each substrate, or both the chemical composition and thickness of the contact surface of each substrate. By separating at least a portion of the interface, the face-to-face surfaces of each substrate are exposed. The multilayer lidding films may also be considered "resealable" when the bond between the two surfaces forms an interface adapted to reseal after separation. Generally, the force required to "reseal" the interface is proportional to the manual pressure exerted on the film. Accordingly, the peelable resealable interface of certain lidding films, may include a first interfacial peel strength and a second interfacial peel strength. Numerous nonlimiting examples of suitable peelable/resealable multilayer films are described in co-owned U.S. Application Publication Nos. 2006/0172131 and 2007/0082161, the disclosure of each of which is incorporated by reference herein in its entirety.

According to certain embodiments, the bond formed between two interior layers of a peelable/resealable multilayer film includes a peelable resealable interface having a first interfacial peel strength "A" and a second interfacial peel strength "B". The peelable resealable interface is adapted to remain secure and unbroken during package fabrication, distribution and storage, and yet may be easily and repeatedly separated and rejoined. Accordingly, the peelable resealable interface includes a first interfacial peel strength, A, having a value of 4.1 kilogram-force per linear inch (40.2 Newton per linear inch) or less as measured in accordance with ASTM F-904-98 test method when the films of the present invention are peeled from a second thermoplastic film to which the film has been heat-sealed. The second interfacial peel strength, B, has a value of at least 0.330 kilogram-force per linear inch (3.2 Newton per linear inch) and, preferably, at least 0.400 kilogram-force per linear inch (3.9 Newton per linear inch) as measured in accordance with ASTM F-904-98 test method when the films are peeled from and re-adhered to a second film. Moreover, the first interfacial peel strength, A, and the second interfacial peel strength, B, are such that the relative values of A and B satisfy the relationship $A \geq B$.

According to certain embodiments of the invention, peelable/resealable functionality may be employed using films where the polymeric first layer and the polymeric second layer each have a predetermined composition and when the polymeric second layer may be positioned in contact with the first and third layers. Accordingly, the polymeric first layer may be an innermost exterior-film layer which may include a first surface and an opposing second surface and which may comprise a heat-sealable, water-insoluble polyester. The polymeric second layer may be an interior-film layer having a first surface and an opposing second surface which may comprise a pressure-sensitive adhesive. The polymeric first and second layers may be coextruded together so that the polymeric first layer is immediately adjacent to and in contact with the polymeric second layer. The bond between the polymeric first and second layers is a peelable/resealable bond such that the polymeric first and second layers may be manually delaminated and re-adhered. The third layer may comprise any material such as a thermoplastic, a cellulosic, a metallic material or combinations thereof which may bond directly with the surface of the polymeric second layer. The third layer may also be coextruded along with the polymeric first and second layers.

In certain embodiments of peelable/resealable lidding films, the heat-sealable, water-insoluble polyester of the polymeric first layer may include, homopolymers and copolymers of alkyl-aromatic esters, such as, for example, but not limited to, polyethylene terephthalate (PET), amorphous polyethylene terephthalate (APET), crystalline polyethylene terephthalate (CPET), glycol-modified polyethylene terephthalate (PETG), and polybutylene terephthalate; copolymers of terephthalate and isophthalate, such as, for example, but not limited to, polyethylene terephthalate/isophthalate copolymer; and homopolymers and copolymers of aliphatic esters such as, for example, polylactic acid (PLA) and polyhydroxyalkonates, such as, for example, but not limited to, polyhydroxypropionate, poly(3-hydroxybutyrate) (PH3B), poly(3-hydroxyvalerate) (PH3V), poly(4-hydroxybutyrate) (PH4B), poly(4-hydroxyvalerate) (PH4V), poly(5-hydroxyvalerate) (PH5V), poly(6-hydroxydodecanoate) (PH6D) and blends of any of these materials.

The pressure sensitive adhesive or tacky adhesive of the polymeric second layer of said peelable/resealable lidding films may comprise an elastomeric first component and a tackifier second component. The elastomeric first component may comprise styrene/rubber copolymers which include, but is not limited to, for example, polystyrene/butadiene/styrene (SBS), polystyrene/isoprene/styrene (SIS), polystyrene/ethylene-butylene/styrene (SEBS), and polystyrene/ethylene-propylene/styrene (SEPS), or blends of any of these materials. The tackifier second component may comprise any tackifier conventionally used with elastomers to form pressure sensitive adhesives. Suitable tackifiers include, but are not limited to, hydrocarbon tackifiers such as terpene resins, such as resins sold under the trademark Zonatac® by Arizona Chemical Company, Jacksonville, Fla., U.S.A., and petroleum hydrocarbon resins, such as resins sold under the trademark Escorez™ by ExxonMobil Chemical Company, Houston, Tex., U.S.A.

According to certain aspects of the invention, the packaging container includes a tamper-evident feature disposed within said peelable or peelable/resealable heat-seal. The tamper-evident feature is not particularly limited and may be any suitable tamper-evident feature known in the art. For example, methods of incorporating a tamper-evident feature into a peelable or peelable/resealable heat-seal may comprise heat-sealing a lidding film to a container using a heat-sealing bar having a surface comprising variable heights, for instance comprising a distorted or gnarled surface. When the lidding film is sealed to the tray, the heat-seal exhibits a substantially transparent appearance; however, when the lidding is peeled apart for the first time after sealing, for instance using digital forces, the heat-seal exhibits a change in opacity, such as a cloudy appearance, thereby providing the tamper evidence.

The disclosure will now be further described in the following non-limiting examples:

Unless otherwise noted, the thermoplastic resins utilized in the present invention are generally commercially available in pellet form and, as generally recognized in the art, may be melt blended or mechanically mixed by well-known methods using commercially available equipment including tumblers, mixers or blenders. Also, if desired, well known additives such as processing aids, slip agents, anti-blocking agents and pigments, and mixtures thereof may be incorporated into the film, by blending prior to extrusion. The resins and any additives are introduced to an extruder where the resins are melt plastified by heating and then transferred to an extrusion (or coextrusion) die for formation into a tube. Extruder and die temperatures will generally depend upon the particular resin or resin containing mixtures being processed and suitable temperature ranges for commercially available resins are generally known in the art, or are provided in technical bulletins made available by resin manufacturers. Processing temperatures may vary depending upon other processing parameters chosen.

In the following examples, all film structures are produced using a single-bubble coextrusion apparatus and method. The single-bubble blown film apparatus includes a multi-manifold annular die head for blown bubble film through which the film composition is forced and formed into a cylindrical tube or bubble. The bubble is immediately quenched, e.g., via cooled water bath, solid surface and/or air, and then ultimately collapsed and formed into a film.

EXAMPLE 1

A packaging container 100 in accordance with FIG. 1 was formed, comprising a thermoformed multilayer oxygen barrier semi-rigid tray 111 and a multilayer peelable lidding film 117. The structure of said tray 111 was as follows: heat-sealable polyethylene terephthalate (PET)/polyvinylidene chloride (PVDC)/polyethylene (PE)/PE and anhydride-modified PE mixture/nylon/ethylene vinyl alcohol copolymer (EVOH)/nylon/PE and anhydride-modified PE mixture/PET. The multilayer tray 111 was formed by thermoforming the above-identified structure into the shape according to FIG. 1 and having a final thickness of 13 mils, comprising a single product-receiving compartment 114, a flange 115 extending around said tray 111 which forms the distal edges 116 of said container, and an easy-open member 118 defining an aperture 120. The length of the container between opposite distal edges 116 of said container was approximately 9 inches. The width of the container between opposite distal edges 116 of said container was approximately 5.5 inches. The depth of the recessed product-receiving compartment 116 was approximately 2 inches. The width of the easy-open member 118 was approximately 1 inch.

The structure of said multilayer peelable lidding film 117 was as follows: oriented PET (OPET)/polyester adhesive/PE/peelable tie/heat-sealable PET. The multilayer lidding film 117 was formed to have a final thickness of 2.5 mils. The multilayer peelable lidding film 117 was heat-sealed to substantially the entire area of said flange 115 and said easy-open member 118. A frangible portion 119 of said lidding film was formed, positioned above the aperture 120, using a laser to score two lines of weakness 121, 122 into the lidding film 117. The lines of weakness 121, 122 had the semi-circular design as illustrated in FIG. 1, and extended approximately 0.5 mils deep, (i.e., about 20% of the total lidding film thickness) into said lidding film 117. The force required to puncture the frangible portion 119 of said lidding film of the sealed packaging container 100 was measured using ASTM F-1306-90 test method, and was determined to be about 20 Newton. Accordingly, the frangible portion 119 of the multilayer lidding film 117 may be broken by the force of a human figure, to assist in gaining access to the product-receiving compartment by a user.

EXAMPLE 2

In Example 2, a packaging container 200 in accordance with FIG. 2 was formed, comprising a thermoformed multilayer oxygen barrier semi-rigid tray 211 and a multilayer peelable lidding film 217. The structure of said tray was the same as the structure in Example 1. The multilayer tray 211 was formed by thermoforming the above-identified structure into the shape according to FIG. 2 and having a final thickness of 13 mils, comprising a single product-receiving compartment 214, a flange 215 extending around said tray 211 which forms the distal edges 216 of said container, and an easy-open member 218 comprising a recessed cavity 220. The length of the container between opposite distal edges 216 of said container was approximately 9 inches. The width of the container between opposite distal edges 216 of said container was approximately 5.5 inches. The depth of the recessed product-receiving compartment 216 was approximately 2 inches. The width of the easy-open member 218 was approximately 1 inch.

The structure of said multilayer peelable lidding film 217 was as follows: 50% ethylene vinyl acetate copolymer (EVA) and 50% linear low density polyethylene (LLDPE)/88% EVA and 12% polybutylene (PB)/neutralized ethylene acid copolymer (ionomer). The multilayer lidding film 217 was formed to have a final thickness of 4.0 mils. The multilayer peelable lidding film 217 was heat-sealed to substantially the entire area of said flange 215 and said easy-open member 218. A frangible portion 219 of said lidding film was formed, positioned above the aperture 220, using a laser to score two lines of weakness 221, 222 into the lidding film 217. The lines of weakness 221, 222 had the semi-circular design as illustrated in FIG. 2, and extended approximately 1.0 mils deep, (i.e., about 25% of the total lidding film thickness) into said lidding film 217. The force required to puncture the frangible portion 219 of said lidding film of the sealed packaging container 200 was measured using ASTM F-1306-90 test method, and was determined to be about 20 Newton. Accordingly, the frangible portion 219 of the multilayer lidding film 217 may be broken by the force of a human figure, to assist in gaining access to the product-receiving compartment by a user.

EXAMPLE 3

In Example 3, a packaging container 300 in accordance with FIG. 3 is formed, comprising a thermoformed multilayer oxygen barrier semi-rigid tray 311 and a multilayer peelable lidding film 317. The structure of said tray was as follows: heat sealable polyethylene (PE)/PE and anhydride-modified PE mixture/ethylene vinyl alcohol copolymer (EVOH)/PE and anhydride-modified PE mixture/PE/polyvinylidene chloride (PVdC) primer/PET. The multilayer tray 311 is formed by thermoforming the structure into the shape according to FIG. 3 and having a final thickness of 13 mils, comprising a single product-receiving compartment 314, a flange 315 extending around said tray 311 which forms the distal edges 316 of said container, and an easy-open member 318 defining an aperture 320. The length of the container between opposite distal edges 316 of said container is approximately 9 inches. The width of the container between opposite distal edges 316 of said container is approximately 5.5 inches. The depth of the recessed product-receiving compartment 316 is approximately 2 inches. The width of the easy-open member 318 is approximately 1 inch.

The structure of said multilayer peelable lidding film 317 is as follows: oriented polyethylene terephthalate (OPET)/EVA/85% EVA and 15% PB/heat sealable LLDPE. The multilayer lidding film 317 is formed to have a final thickness of 2.5 mils. The multilayer peelable lidding film 317 is heat-sealed to substantially the entire area of said flange 315 and said easy-open member 318, as depicted in FIG. 3. A frangible portion 319 of said lidding film is formed, positioned above the aperture 320, using a laser to score two lines of weakness 321, 322 into the lidding film 317. The lines of weakness 321, 322 have the semi-circular design as illustrated in FIG. 3, and extend approximately 0.5 mils deep, (i.e., 20% of the total lidding film thickness) into said lidding film 317. The force required to puncture the frangible portion 319 of said lidding film of the sealed packaging container 300 is about 20 Newton, measured using ASTM F-1306-90 test method. Accordingly, the frangible portion 319 of the multilayer lidding film 317 may be broken by the force of a human figure, to assist in gaining access to the product-receiving compartment by a user.

EXAMPLE 4

In Example 3, a packaging container 400 in accordance with FIG. 4 is formed, comprising a thermoformed multilayer oxygen barrier semi-rigid tray 411 and a multilayer peelable lidding film 417. The structure of said tray is the same as the structure in Example 3. The multilayer tray 411 is formed by thermoforming the above-identified structure into the shape according to FIG. 4 and having a final thickness of 13 mils, comprising a single product-receiving compartment 414, a flange 415 extending around said tray 411 which forms the distal edges 416 of said container, and an easy-open member 418 defining an aperture 220. The length of the container between opposite distal edges 416 of said container is approximately 9 inches. The width of the container between opposite distal edges 416 of said container is approximately 5.5 inches. The depth of the recessed product-receiving compartment 416 is approximately 2 inches. The width of the easy-open member 418 is approximately 1 inch.

The structure of said multilayer peelable lidding film 417 is as follows: OPET/LLDPE/88% LLDPE and 12% PB/heat sealable neutralized ethylene acid copolymer (ionomer). The multilayer lidding film 417 is formed to have a final thickness of 2.5 mils. The multilayer peelable lidding film 417 is heat-sealed to a significant amount of the area of said flange 415; however, a portion of said lidding film 417 remains unsealed to a portion of the flange and said easy-open member 418, as depicted in FIG. 4. A frangible portion 419 of said lidding film is formed, positioned above the aperture 420, using a laser to score two lines of weakness 421, 422 into the lidding film 417. The lines of weakness 421, 422 have the semi-circular design as illustrated in FIG. 4, and extend approximately 0.5 mils deep, (i.e., 20% of the total lidding film thickness) into said lidding film 417. The force required to puncture the frangible portion 419 of said lidding film of the sealed packaging container 400 is about 20 Newton, measured using ASTM F-1306-90 test method. Accordingly, the frangible portion 419 of the multilayer lidding film 417 may be broken by the force of a human figure, to assist in gaining access to the product-receiving compartment by a user.

EXAMPLE 5

In Example 5, a packaging container 500 in accordance with FIG. 5 was formed, comprising a thermoformed multilayer oxygen barrier semi-rigid tray 511 and a multilayer peelable/resealable lidding film 517. The structure of said tray was the same as the structure in Example 1. The multilayer tray 511 was formed by thermoforming the above-identified structure into the shape according to FIG. 5 and having a final thickness of 13 mils, comprising a single product-receiving compartment 514, a flange 515 extending around said tray 511 which forms the distal edges 516 of said container, and an easy-open member 518 defining an aperture 520. The length of the container between opposite distal edges 516 of said container was approximately 9 inches. The width of the container between opposite distal edges 516 of said container was approximately 5.5 inches. The depth of the recessed product-receiving compartment 516 was approximately 2 inches. The width of the easy-open member 518 was approximately 1 inch.

The structure of said multilayer peelable/resealable lidding film 517 was as follows: OPET/polyester adhesive/PE/tie/EVOH/tie/pressure sensitive adhesive (PSA)/heat-sealable PET. The multilayer lidding film 517 was formed to have a final thickness of 4.0 mils. The multilayer peelable/resealable lidding film 517 was heat-sealed to substantially the entire area of said flange 515 and said easy-open member 518. A frangible portion 519 of said lidding film was formed, positioned above the aperture 520, using a laser to score two lines of weakness 521, 522 into the lidding film 517. The lines of weakness 521, 522 had the semi-circular design as illustrated in FIG. 5, and extended approximately 1.25 mils deep, (i.e., about 31% of the total lidding film thickness) into said lidding film 517. The force required to puncture the frangible portion 519 of said lidding film of the sealed packaging container 500 was measured using ASTM F-1306-90 test method, and was determined to be about 20 Newton. Accordingly, the frangible portion 519 of the multilayer lidding film 517 may be broken by the force of a human figure, to assist in gaining access to the product-receiving compartment by a user.

While various embodiments of the disclosure are herein described, it is envisioned that those skilled in the art may devise various modifications and equivalents without departing from the spirit and scope of the disclosure. The disclosure is not intended to be limited by the foregoing detailed description. Those skilled in the art will appreciate that there are numerous variations and permutations of the above described systems and techniques that fall within the spirit and scope of the invention. It should be understood that the invention is not limited in its application to the details of construction and arrangements of the components set forth herein. Variations and modifications of the foregoing are within the scope of the present invention. It is also being understood that the invention disclosed and defined herein extends to all alternative combinations of two or more of the individual features mentioned or evident from the text and/or drawings. All of these different combinations constitute various alternative aspects of the present invention. The claims are to be construed to include alternative embodiments to the extent permitted by the prior art.

What is claimed is:

1. An easy-open reusable packaging container comprising:

a rigid or semi-rigid tray comprising a bottom and at least one side wall which forms at least one recessed product-receiving compartment, and a flange extending around said tray which forms distal edges of said container;

a lidding film affixed to said flange which forms a peelable/resealable heat-seal extending around said product-receiving compartment and said distal edges of said container; and an easy-open member positioned between said product-receiving compartment and said distal edges of said container, and comprising:

a frangible portion of said lidding film which forms a tab member when punctured to provide a means for removing said lidding film from said flange and gaining access to said product-receiving compartment;

wherein said easy-open member further comprises a first line of weakness in said frangible portion of said lidding film extending from a first distal edge of said container to a point of intersection with a second line of weakness in said frangible portion of said lidding film extending from an adjacent second distal edge of said container to said point of intersection with said first line of weakness thereby forming a first portion of said lidding film which remains affixed to said package and a second portion of said lidding film which is removable from one distal edge to an opposing second distal edge of said container without further tearing of said lidding film other than tearing that occurs along the first and second lines of weakness.

2. A container of claim 1 wherein said easy-open member further comprises an aperture in said flange positioned below said frangible portion of said lidding film.

3. A container of claim 1 wherein said easy-open member further comprises a recessed cavity of said flange positioned below said frangible portion of said lidding film.

4. A container of claim 1 wherein said lidding film is peelably heat-sealed to a first area of said flange having a width of at least 0.25 inch and adjacent to said product-receiving compartment, and a second area of said flange having a width of at least 0.25 inch and adjacent to said distal edges of said container.

5. A container of claim 1 wherein said lidding film is peelably heat-sealed to the entire area of said flange.

6. A container of claim 1 wherein a force required to puncture said frangible portion of said lidding film is between about 0.5 Newton and about 20.0 Newton as measured in accordance with ASTM F-1306-90 test method.

7. A container of claim 1 further comprising a tamper-evident feature disposed within said peelable heat-seal.

8. A container of claim 1 wherein said tray is a monolayer film.

9. A container of claim 1 wherein said tray is a multilayer film.

10. A container of claim 1 wherein said lidding film is a monolayer film.

11. A container of claim 1 wherein said lidding film is a multilayer film.

12. A container of claim 1 further comprising a plurality of recessed product-receiving compartments.

13. An easy-open packaging container comprising:

a rigid or semi-rigid tray comprising a bottom and at least one side wall which forms at least one recessed product-receiving compartment, and a flange extending around said tray which forms distal edges of said container;

a lidding film affixed to said flange which forms a peelable heat-seal extending around said product-receiving compartment and said distal edges of said container; and an easy-open member positioned between said product-receiving compartment and said distal edges of said container, and comprising:

a frangible portion of said lidding film unsealed to said flange and an aperture in said flange positioned below said frangible portion of said lidding film;

wherein said frangible portion of said lidding film forms a tab member when punctured to provide a means for removing said lidding film from said flange and gaining access to said at least one recessed product-receiving compartment;

wherein said easy-open member further comprises a first line of weakness in said frangible portion of said lidding film extending from a first distal edge of said container to point of intersection with second line of weakness in said frangible portion of said lidding film extending from an adjacent second distal edge of said container to said point of intersection with said first line of weakness thereby forming a first portion of said lidding film which remains affixed to said package and a second portion of said lidding film which is removable from one distal edge to an opposing second distal edge of said container without further tearing of said lidding film other than tearing that occurs along the first and second lines of weakness.

14. A container of claim 13 wherein said lidding film is peelably heat-sealed to a first area of said flange having a width of at least 0.25 inch and adjacent to said product-receiving compartment, and a second area of said flange having a width of at least 0.25 inch and adjacent to said distal edges of said container.

15. A container of claim 13 wherein said lidding film is peelably heat-sealed to the entire area of said flange.

16. A container of claim 13 wherein a force required to puncture said frangible portion of said lidding film is between about 0.5 Newton and about 20.0Newton or less as measured in accordance with ASTM F-1306-90 test method.

17. A container of claim 13 further comprising a tamper-evident feature disposed within said peelabie heat-seal.

18. A container of claim 13 wherein said tray is a mono-layer film

19. A container of claim 13 wherein said tray is a multilayer film,

20. A container of claim 13 wherein said lidding film is a monolayer film.

21. A container of claim 13 wherein said lidding film is a multilayer film.

22. A container of claim 13 further comprising a plurality of recessed product-receiving compartments.

* * * * *

UNITED STATES PATENT AND TRADEMARK OFFICE

CERTIFICATE OF CORRECTION

PATENT NO. : 8,684,217 B2
APPLICATION NO. : 12/971212
DATED : April 1, 2014
INVENTOR(S) : Peter Brian Bruehl et al.

It is certified that error appears in the above-identified patent and that said Letters Patent is hereby corrected as shown below:

In the Specification

In column 6, line 24, delete "polyauryllactam" and insert -- polylauryllactam --, therefor.

In column 14, lines 65-66, delete "polyhydroxyalkonates," and insert -- polyhydroxyalkanoates, --, therefor.

In the Claims

In column 21, line 1, in claim 16, delete "20.0Newton" and insert -- 20.0 Newton --, therefor.

In column 21, line 4, in claim 17, delete "peelabie" and insert -- peelable --, therefor.

In column 21, line 6, in claim 18, delete "film" and insert -- film. --, therefor.

In column 21, line 8, in claim 19, delete "film," and insert -- film. --, therefor.

Signed and Sealed this
Fourteenth Day of July, 2015

Michelle K. Lee

Michelle K. Lee
*Director of the United States Patent and Trademark Office*